US009761180B2

(12) United States Patent
Ogawa

(10) Patent No.: US 9,761,180 B2
(45) Date of Patent: Sep. 12, 2017

(54) INTEGRATED CIRCUIT, DISPLAY DEVICE, ELECTRONIC APPARATUS, AND DISPLAY CONTROL METHOD

(71) Applicant: SEIKO EPSON CORPORATION, Tokyo (JP)

(72) Inventor: Hideki Ogawa, Fujimi-machi (JP)

(73) Assignee: SEIKO EPSON CORPORATION, Tokyo (JP)

( * ) Notice: Subject to any disclaimer, the term of this patent is extended or adjusted under 35 U.S.C. 154(b) by 91 days.

(21) Appl. No.: 14/455,799

(22) Filed: Aug. 8, 2014

(65) Prior Publication Data

US 2015/0077442 A1 Mar. 19, 2015

(30) Foreign Application Priority Data

Aug. 9, 2013 (JP) ..... 2013-166182
Jun. 25, 2014 (JP) ..... 2014-129970

(51) Int. Cl.
*G09G 3/38* (2006.01)
*G09G 3/34* (2006.01)
*G09G 3/36* (2006.01)

(52) U.S. Cl.
CPC ..... *G09G 3/344* (2013.01); *G09G 3/3651* (2013.01); *G09G 3/3426* (2013.01); *G09G 3/3453* (2013.01); *G09G 3/38* (2013.01); *G09G 2300/0486* (2013.01); *G09G 2300/08* (2013.01); *G09G 2310/061* (2013.01); *G09G 2310/068* (2013.01); *G09G 2320/0257* (2013.01); *G09G 2340/16* (2013.01)

(58) Field of Classification Search
CPC ..... G09G 3/344; G09G 2310/061; G09G 2320/0257; G09G 3/3651; G09G 2300/0486; G09G 3/3426; G09G 2310/068; G09G 3/38; G09G 3/3453
See application file for complete search history.

(56) References Cited

U.S. PATENT DOCUMENTS 5,844,536 A * 12/1998 Okada ..... G02F 1/133371 345/94
5,953,002 A * 9/1999 Hirai ..... G09G 3/2011 345/204
6,061,042 A * 5/2000 Takahashi ..... G09G 3/2011 345/87

(Continued)

FOREIGN PATENT DOCUMENTS

JP 2004-029538 A 1/2004
JP 2007-108355 A 4/2007

(Continued)

*Primary Examiner* — Michael J Eurice
(74) *Attorney, Agent, or Firm* — Maschoff Brennan

(57) ABSTRACT

An integrated circuit accesses a first storage section that stores a plurality of pattern groups of voltage application for changing an optical state of a pixel to a designated gray level, and outputs a control signal for applying a voltage to a single target pixel of a plurality of pixels as defined above, the voltage being indicated by a pattern that is contained in a pattern group of the plurality of pattern groups that is selected in accordance with the position of the single pixel and the gray level value of the single pixel, the gray level value being indicated by image data acquired by an acquiring section.

12 Claims, 10 Drawing Sheets

(56) References Cited

U.S. PATENT DOCUMENTS 6,504,524 B1* 1/2003 Gates ..... G02F 1/167 315/169.3
6,531,997 B1* 3/2003 Gates ..... G02F 1/167 204/606
7,071,930 B2 7/2006 Kondo et al.
7,119,772 B2 10/2006 Amundson et al.
8,102,363 B2 1/2012 Hirayama
2002/0005832 A1* 1/2002 Katase ..... G02F 1/167 345/107
2002/0036611 A1* 3/2002 Ishii ..... G09G 3/3659 345/89
2002/0097236 A1* 7/2002 Aoki ..... G09G 3/3611 345/204
2002/0118304 A1* 8/2002 Mandl ..... G09G 3/20 348/671
2003/0137521 A1* 7/2003 Zehner ..... G02F 1/167 345/589
2003/0169247 A1* 9/2003 Kawabe ..... G09G 3/342 345/204
2004/0056854 A1* 3/2004 Kondo ..... G09G 3/20 345/204
2004/0239656 A1* 12/2004 Yamazaki ..... G09G 3/3648 345/204
2005/0001812 A1* 1/2005 Amundson ..... G02F 1/167 345/107
2005/0024353 A1* 2/2005 Amundson ..... G02F 1/167 345/204
2005/0052346 A1* 3/2005 Koyama ..... G09G 3/3611 345/32
2005/0083284 A1* 4/2005 Huang ..... G09G 3/3651 345/88
2005/0280626 A1* 12/2005 Amundson ..... G09G 3/344 345/107
2006/0232547 A1 10/2006 Johnson et al.
2007/0075962 A1* 4/2007 Zhou ..... G09G 3/344 345/107
2007/0080928 A1 4/2007 Ishii et al.
2007/0126678 A1* 6/2007 Shih ..... G09G 3/342 345/89
2007/0252795 A1* 11/2007 Shiomi ..... G09G 3/2048 345/87
2007/0273713 A1* 11/2007 Wubben ..... G09G 3/3607 345/690
2008/0024482 A1 1/2008 Gates et al.
2008/0048945 A1* 2/2008 Jo ..... G09G 3/3233 345/76
2008/0211833 A1* 9/2008 Inoue ..... G09G 3/2018 345/690
2008/0238867 A1* 10/2008 Maeda ..... G09G 3/344 345/107
2008/0309598 A1* 12/2008 Doane ..... G02F 1/13475 345/87
2009/0058797 A1* 3/2009 Hirayama ..... G09G 3/344 345/107
2009/0153743 A1* 6/2009 Arashima ..... G09G 3/3648 348/699
2009/0161042 A1* 6/2009 Inoue ..... G02F 1/134363 349/96
2009/0179923 A1* 7/2009 Amundson ..... G09G 3/344 345/690
2009/0267969 A1* 10/2009 Sakamoto ..... G09G 3/2081 345/690
2009/0322665 A1* 12/2009 Yoshihara ..... G02F 1/1347 345/94
2010/0156878 A1* 6/2010 Chen ..... G09G 3/3611 345/212
2010/0225677 A1* 9/2010 Shingai ..... G09G 3/3629 345/690
2010/0231571 A1* 9/2010 Tanabe ..... G09G 3/344 345/211
2010/0231579 A1* 9/2010 Kanbayashi ..... G09G 3/344 345/214
2011/0187684 A1* 8/2011 Amundson ..... G09G 3/344 345/204
2011/0216046 A1* 9/2011 Nishizawa ..... G09G 3/34 345/204
2011/0267383 A1* 11/2011 Murakami ..... G09G 3/3426 345/690
2011/0292092 A1* 12/2011 Ozawa ..... G09G 3/344 345/690
2011/0292093 A1* 12/2011 Ozawa ..... G09G 3/344 345/690
2012/0081413 A1* 4/2012 Nose ..... G09G 3/2014 345/690
2012/0086740 A1* 4/2012 Murai ..... G09G 3/3406 345/690
2012/0139963 A1* 6/2012 Lee ..... G09G 3/344 345/690
2012/0256893 A1* 10/2012 Sakamoto ..... G09G 3/2003 345/208
2013/0135363 A1* 5/2013 Lin ..... G09G 3/344 345/690
2014/0104277 A1* 4/2014 Roosendaal ..... G02F 1/133514 345/428
2014/0307003 A1* 10/2014 Choi ..... G09G 3/3648 345/690
2016/0196781 A1* 7/2016 Tanaka ..... G09G 3/3688 345/691

FOREIGN PATENT DOCUMENTS

JP 2007-530984 A 11/2007
JP 2009-042780 A 2/2009
JP 2009-058645 A 3/2009
JP 2009-063651 A 3/2009
JP 2010-026159 A 2/2010
JP 2011-008271 A 1/2011

* cited by examiner

| Current gray level | Next gray level | Frame number | | | |
|---|---|---|---|---|---|
| | | 1 | 2 | 3 | 4 |
| Bk | Bk | 0 | 0 | 0 | 0 |
| | DG | - | 0 | 0 | 0 |
| | LG | - | - | 0 | 0 |
| | Wt | - | - | - | - |
| DG | Bk | + | + | 0 | 0 |
| | DG | 0 | 0 | 0 | 0 |
| | LG | - | - | 0 | 0 |
| | Wt | - | - | - | 0 |
| LG | Bk | + | + | + | 0 |
| | DG | + | + | 0 | 0 |
| | LG | 0 | 0 | 0 | 0 |
| | Wt | - | 0 | 0 | 0 |
| Wt | Bk | + | + | + | + |
| | DG | + | + | + | 0 |
| | LG | + | 0 | 0 | 0 |
| | Wt | 0 | 0 | 0 | 0 |

FIG. 5

FIG. 6A
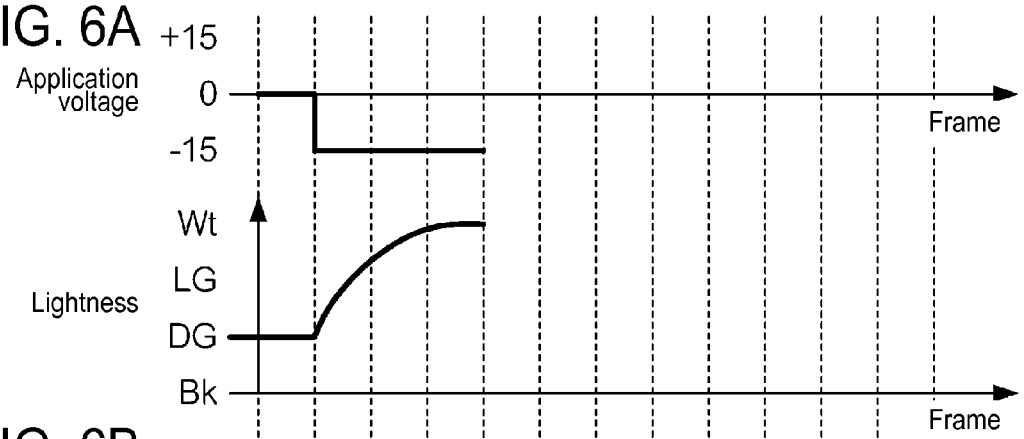
FIG. 6B
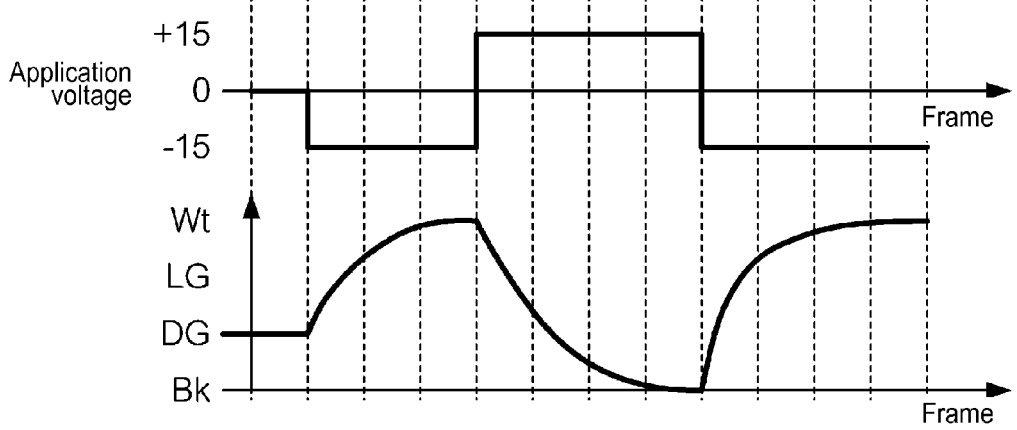
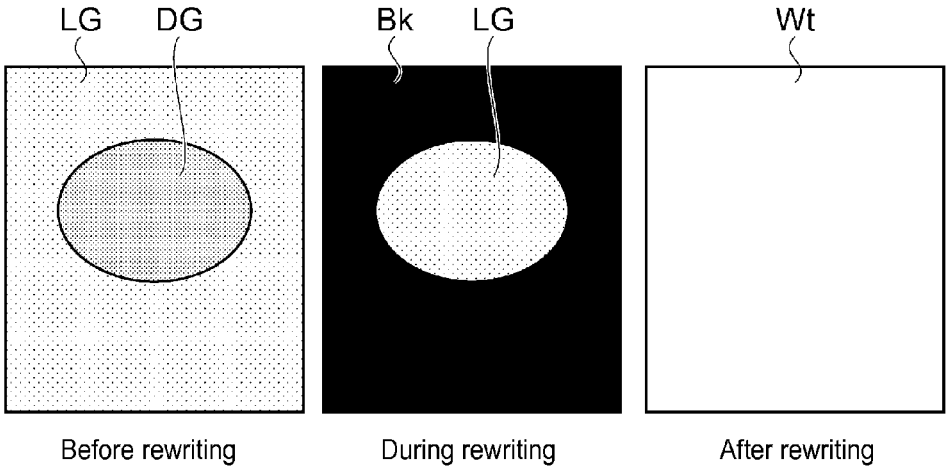
FIG. 7

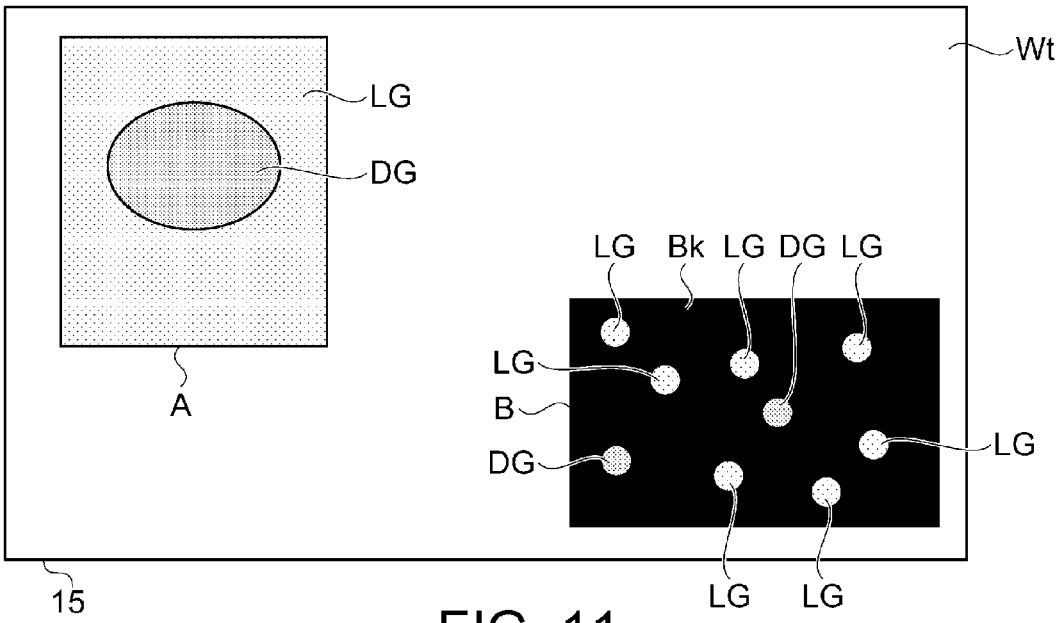
FIG. 11
| Instruction | Region | Pipe | Key color |
|---|---|---|---|
| C1 | A | $P_1$ | LG |
| C2 | A | $P_2$ | DG |
| C3 | B | $P_3$ | LG |
| C4 | B | $P_4$ | DG |
| C5 | B | $P_5$ | Bk |
FIG. 12
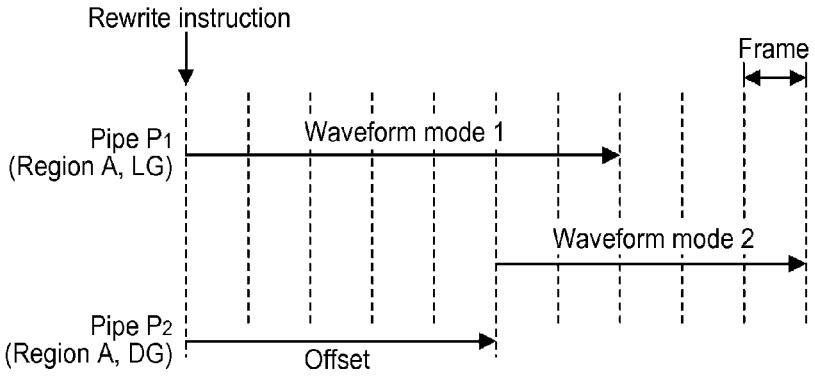
FIG. 13

FIG. 14A

<Waveform mode 1>

| Current gray level | Next gray level | Frame number | | | | | | | | | |
|---|---|---|---|---|---|---|---|---|---|---|---|
| | | 0 | 1 | 2 | 3 | 4 | 5 | 6 | 7 | 8 | 9 |
| Bk | Bk | 0 | 0 | 0 | 0 | 0 | 0 | 0 | 0 | 0 | 0 |
| | DG | − | − | 0 | 0 | 0 | 0 | 0 | 0 | 0 | 0 |
| | LG | − | − | − | − | 0 | 0 | 0 | 0 | 0 | 0 |
| | Wt | 0 | 0 | − | − | − | − | − | − | 0 | 0 |
| DG | Bk | − | − | − | − | + | + | + | + | + | + |
| | DG | 0 | 0 | 0 | 0 | 0 | 0 | 0 | 0 | 0 | 0 |
| | LG | 0 | 0 | 0 | 0 | 0 | 0 | 0 | 0 | − | − |
| | Wt | 0 | 0 | 0 | 0 | 0 | 0 | − | − | − | − |
| LG | Bk | − | − | + | + | + | + | + | + | 0 | 0 |
| | DG | − | − | + | + | + | + | + | + | − | − |
| | LG | 0 | 0 | 0 | 0 | 0 | 0 | 0 | 0 | 0 | 0 |
| | Wt | 0 | 0 | 0 | 0 | 0 | 0 | 0 | 0 | − | − |
| Wt | Bk | 0 | 0 | 0 | 0 | + | + | + | + | + | + |
| | DG | 0 | 0 | + | + | + | + | + | + | − | − |
| | LG | + | + | + | + | + | + | − | − | − | − |
| | Wt | 0 | 0 | 0 | 0 | 0 | 0 | 0 | 0 | 0 | 0 |

FIG. 14B

<Waveform mode 2>

| Current gray level | Next gray level | Frame number | | | | | | | |
|---|---|---|---|---|---|---|---|---|---|
| | | 0 | 1 | 2 | 3 | 4 | 5 | 6 | 7 |
| Bk | Bk | 0 | 0 | 0 | 0 | 0 | 0 | 0 | 0 |
| | Wt | − | − | − | − | 0 | 0 | 0 | 0 |
| DG | Bk | 0 | − | − | − | + | + | + | + |
| | Wt | 0 | 0 | − | − | − | 0 | 0 | 0 |
| LG | Bk | − | − | + | + | + | + | 0 | 0 |
| | Wt | 0 | 0 | 0 | − | − | 0 | 0 | 0 |
| Wt | Bk | 0 | 0 | 0 | 0 | + | + | + | + |
| | Wt | 0 | 0 | 0 | 0 | 0 | 0 | 0 | 0 |

INTEGRATED CIRCUIT, DISPLAY DEVICE, ELECTRONIC APPARATUS, AND DISPLAY CONTROL METHOD

BACKGROUND

1. Technical Field

The present invention relates to a technology that is used for a display device employing a bi-stable display element as a display element.

2. Related Art

In bi-stable display elements, in order to improve the rewrite speed, partial rewriting is performed in which only a portion of a display region is rewritten (for example, JP-A-2009-42780 and JP-T-2007-530984).

Only one type of look-up table (LUT) is used to cause transitions between gray levels. Therefore, in some cases, a transition of the gray level of a pixel during update looks strange to a viewer.

SUMMARY

Some aspects of the invention can be realized as the following embodiment or examples of application.

Example of Application

An integrated circuit according to an example of application has an acquiring section that acquires image data indicating an image to be displayed by a bi-stable display element, the bi-stable display element having a pixel whose gray level changes in accordance with an application voltage, and an output section that accesses a first storage section that stores a plurality of pattern groups of voltage application for changing an optical state of the pixel to a designated gray level, and outputs a control signal for applying a voltage to a single target pixel of a plurality of pixels as defined above, the voltage being indicated by a pattern that is contained in a pattern group of the plurality of pattern groups that is selected in accordance with a position of the single pixel and a gray level value of the single pixel, the gray level value being indicated by the image data that is acquired by the acquiring section.

With this integrated circuit, rewriting can be performed using different voltage application patterns for different pixels in accordance with the gray level values of the respective pixels.

It is preferable that the output section includes a plurality of sub-output sections, a single gray level of a plurality of gray levels that can be produced by the bi-stable display element is assigned to each of the plurality of sub-output sections, and each of the plurality of sub-output sections outputs the control signal for a pixel with respect to which the image data indicates the corresponding single gray level.

With this integrated circuit, rewriting can be performed using different voltage application patterns for different gray levels by using the plurality of sub-output sections to which the gray level values are respectively assigned.

It is preferable that a portion of a display region containing a plurality of pixels as defined above is assigned to each of the plurality of sub-output sections, and each of the plurality of sub-output sections outputs the control signal for the single pixel that is contained in the assigned display region.

With this integrated circuit, rewriting can be performed using different voltage application patterns for different gray levels by using the plurality of sub-output sections to each of which a gray level value and a portion of the display region are assigned.

It is preferable that the pattern indicates a change in application voltage in every unit time period, each of the plurality of sub-output sections has a counter for specifying a single time period in the pattern, and each of the plurality of sub-output sections outputs the control signal that applies a voltage corresponding to the single time period of the pattern that is specified by the counter to the single pixel.

With this integrated circuit, a voltage of the voltage application pattern can be applied, the voltage being specified by the value of the counter.

It is preferable that each of the plurality of sub-output sections uses a value that depends on a designated number of unit time periods and a number of unit time periods in the selected pattern group as an initial value of the counter.

With this integrated circuit, the time of commencement of voltage application in accordance with the pattern can be varied from one sub-output section to another.

It is preferable that a single pattern group of the plurality of pattern groups is assigned to each of the plurality of sub-output sections, and each of the plurality of sub-output sections outputs the control signal that applies a voltage indicated by a pattern that is contained in the assigned single pattern group to the single pixel.

Furthermore, it is preferable that the integrated circuit further includes a second storage section that stores first image data indicating gray levels of respective pixels of an image after rewriting and a third storage section that stores second image data indicating gray levels of respective pixels of an image before rewriting, and the acquiring section acquires the first image data and the second image data as the image data.

With this integrated circuit, rewriting can be performed using different voltage application patterns for different pixels in accordance with images before and after rewriting.

Example of Application

A display device according to an example of application preferably has any one of the above-described integrated circuits and the bi-stable display element.

With this display device, rewriting can be performed using different voltage application patterns for different pixels.

Example of Application

An electronic apparatus according to an example of application preferably has the above-described display device and a host device that controls the display device.

With this electronic apparatus, rewriting can be performed using different voltage application patterns for different pixels.

Example of Application

A display control method according to an example of application provides a display control method including acquiring image data that indicates an image to be displayed by a bi-stable display element, the bi-stable display element having a pixel whose gray level changes in accordance with an application voltage, accessing a first storage section that stores a plurality of pattern groups of voltage application for changing an optical state of the pixel to a designated gray level, and performing control so as to apply a voltage to a single target pixel of a plurality of pixels as defined above, the voltage being indicated by a pattern that is contained in a pattern group of the plurality of pattern groups that is selected in accordance with a position of the single pixel and a gray level value of the single pixel, the gray level value being indicated by the image data that is acquired by the acquiring section.

With this display control method, rewriting can be performed using different voltage application patterns for different pixels.

Example of Application

Another integrated circuit according to an example of application is an integrated circuit that controls a bi-stable display element having a pixel, the integrated circuit including an output unit that outputs a control signal corresponding to a voltage application pattern for changing a gray level of a displayed color of the pixel, a first storage unit that stores a plurality of drive waveform tables, each drive waveform table containing a plurality of voltage application patterns as defined above, and an acquiring unit that acquires image data to be displayed by the pixel, wherein the voltage application pattern is selected from the drive waveform tables using gray level data before a transition of the gray level of the pixel and gray level data after the transition, and the drive waveform table to be used for the selection of the voltage application pattern is selected using the gray level data before the transition or the gray level data after the transition of the pixel.

With this configuration, it is possible to use voltage application patterns that are suited to change gray levels of individual pixels included in the bi-stable display element on a pixel-by-pixel basis, by selecting a drive waveform table from the plurality of drive waveform tables using either the gray level data before the transition or the gray level data after the transition of a pixel as a key color, and selecting an voltage application pattern from the selected drive waveform table using the gray level data before the transition and the gray level data after the transition of the pixel.

In still another integrated circuit of this example of application, it is preferable that the output unit has a second storage unit, the drive waveform table to be used for the selection of the voltage application pattern is read from the first storage unit, associated with a predetermined gray level, and stored in the second storage unit in advance, and if the gray level data before the transition or the gray level data after the transition of the pixel is the same as the predetermined gray level, the voltage application pattern is selected from the drive waveform table that is stored in the second storage unit.

With this configuration, the frequency at which the output unit accesses the first storage unit can be reduced by storing a drive waveform table corresponding to a key color from the first storage unit to the second storage unit in the output unit in advance.

BRIEF DESCRIPTION OF THE DRAWINGS

The invention will be described with reference to the accompanying drawings, wherein like numbers reference like elements.

FIG. 5 illustrates a drive waveform table.

FIGS. 6A and 6B are diagrams each illustrating a gray level transition of an electrophoretic element 143 due to a drive waveform.

FIG. 7 is a diagram for explaining a problem with a driving method according to related art.

FIG. 11 is a diagram illustrating an image after rewriting.

FIG. 12 is a table illustrating designation of regions, pipes, and key colors.

FIG. 13 is a diagram illustrating a drive waveform offset.

FIGS. 14A and 14B are tables showing drive waveform modes with different voltage application patterns.

DESCRIPTION OF EXEMPLARY EMBODIMENTS

1. Overview

Figure 1:
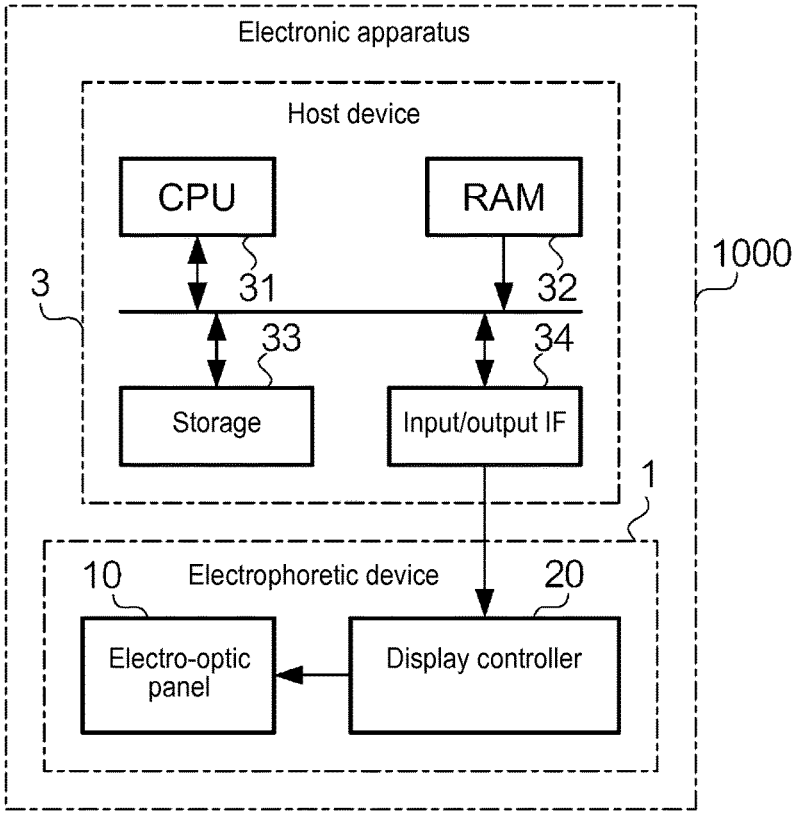
FIG. 1 is a diagram showing the configuration of an electronic apparatus 1000 according to an embodiment.

FIG. 1 is a diagram showing the configuration of an electronic apparatus 1000 according to an embodiment. The electronic apparatus 1000 may be, for example, a tablet computer. The electronic apparatus 1000 has an electro-optical device 1 and a host device 3. The electro-optical device 1 is a display device that displays at least either of characters and images. In this example, the electro-optical device 1 has an electro-optical panel 10 and a display controller 20. The electro-optical panel 10 is a device that employs an electro-optical element, in particular a bi-stable display element that can keep displaying without requiring power to be supplied thereto, and more specifically, an EPD (electrophoretic display) that employs an electrophoretic element serving as the bi-stable display element. The display controller 20 is a device that controls the electro-optical panel 10.

The host device 3 has a CPU (central processing unit) 31, a RAM (random access memory) 32, a storage 33, and an input/output IF (interface) 34. The CPU 31 is a device that controls the other hardware configurations of the electronic apparatus 1000. The RAM 32 is a storage that functions as a work area when the CPU 31 executes a program. The storage 33 is a nonvolatile storage that stores data and programs. The input/output IF 34 is an interface that allows the host device 3 to input/output data or signals from/to other devices. In this example, a signal is supplied to the display controller 20 via the input/output IF 34. In addition to these, the electronic apparatus 1000 has an input device (e.g., a touchscreen, a keypad, and the like) and a communication device (e.g., a wireless communication device) (both not shown).

Figure 2:
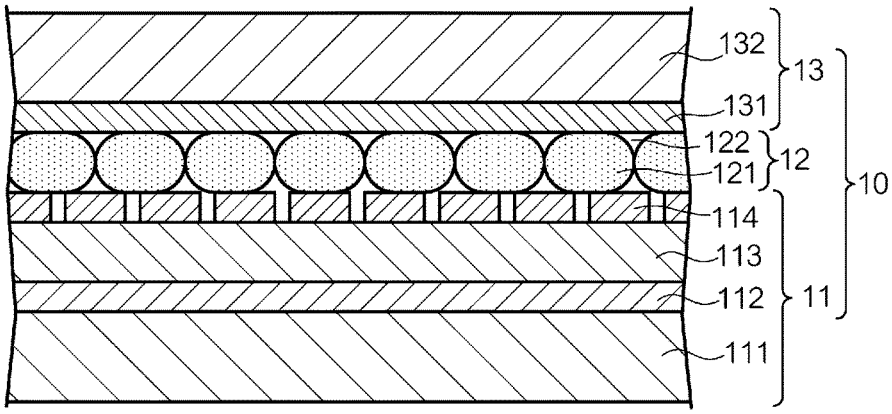
FIG. 2 is a schematic diagram showing a cross-sectional structure of an electro-optical panel 10.

FIG. 2 is a schematic diagram showing a cross-sectional structure of the electro-optical panel 10. The electro-optical panel 10 has a first substrate 11, an electrophoretic layer 12, and a second substrate 13. The first substrate 11 and the second substrate 13 are substrates for holding the electrophoretic layer 12 therebetween.

The first substrate 11 has a substrate 111, an adhesive layer 112, and a circuit layer 113. The substrate 111 is formed of an insulating material, such as glass. In another example, the substrate 111 may be formed of a material having not only insulating properties but also flexibility and lightweight properties, such as polycarbonate. The adhesive layer 112 is a layer that bonds the substrate 111 and the circuit layer 113 together. The circuit layer 113 is a layer having a circuit for driving the electrophoretic layer 12. The circuit layer 113 has pixel electrodes 114.

The electrophoretic layer 12 has microcapsules 121 and a binder 122. The microcapsules 121 are fixed by the binder 122. A material having a good affinity for the microcapsules 121, excellent adhesion to the electrodes, and insulating properties is used as the binder 122. The microcapsules 121 are each a capsule having a dispersion medium and electrophoretic particles contained inside. A pliable material, such as a gum arabic-gelatin-based compound, a urethane-based compound, or the like, is used for the microcapsules 121. Note that it is also possible that an adhesive layer formed of an adhesive is provided between the microcapsules 121 and the pixel electrodes 114.

Electrophoretic particles are particles (macromolecules or colloids) having a property of moving in a dispersion medium under the influence of an electric field. In this embodiment, white electrophoretic particles and black electrophoretic particles are contained in each microcapsule 121. The black electrophoretic particles are particles including a black pigment such as, for example, aniline black, carbon black, or the like, and are positively charged in this embodiment. The white electrophoretic particles are particles including a white pigment such as, for example, titanium dioxide, aluminum oxide, or the like, and are negatively charged in this embodiment.

The second substrate 13 has a common electrode 131 and a film 132. The film 132 seals and protects the electrophoretic layer 12. The film 132 is formed of a transparent insulating material, such as polyethylene terephthalate. The common electrode 131 is formed of a transparent conductive material, such as indium tin oxide (ITO).

Figure 3:
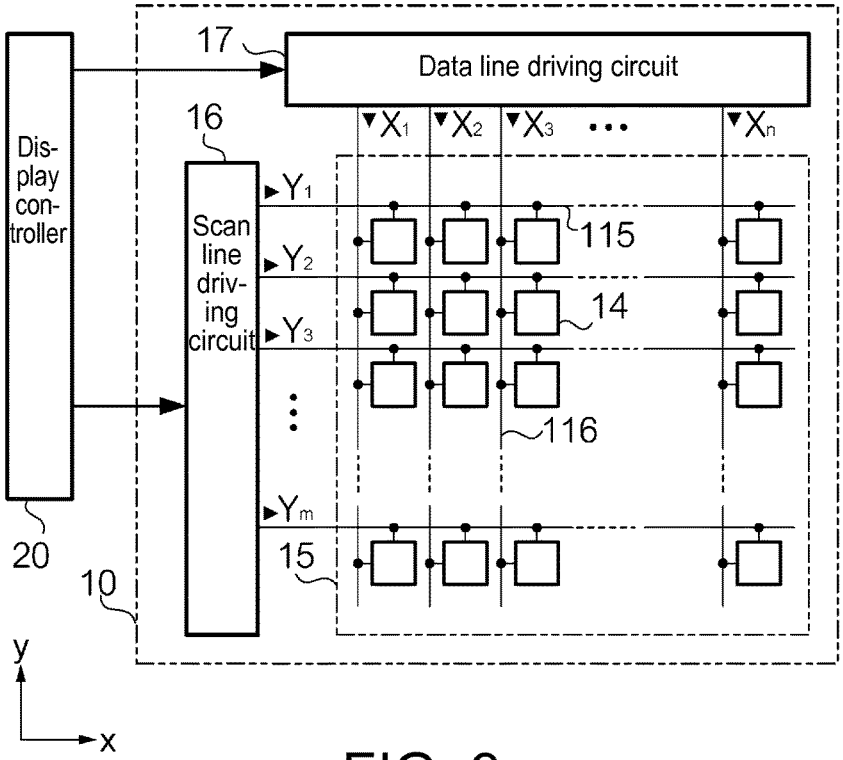
FIG. 3 is a diagram showing the configuration of a circuit of the electro-optical panel 10.

FIG. 3 is a diagram showing the configuration of a circuit of the electro-optical panel 10. The electro-optical panel 10 has "m" scan lines 115, "n" data lines 116, "m×n" pixels 14, a scan line driving circuit 16, and a data line driving circuit 17. The "m×n" pixels 14 form a display region 15. The scan line driving circuit 16 and the data line driving circuit 17 are controlled by the display controller 20. The scan line driving circuit 16, the data line driving circuit 17, and the display controller 20 are each an integrated circuit that is mounted on the substrate 111 using COG (chip on glass) technology. The scan lines 115 are arranged extending in a row direction (x-direction) and transmit scan signals. The scan signals are signals that sequentially and exclusively select each scan line 115 of the "m" scan lines 115. The data lines 116 are arranged extending in a column direction (y-direction) and supply data voltages to the pixels 14. The scan lines 115 and the data lines 116 are insulated. The pixels 14 are provided corresponding to crossings of the scan lines 115 and the data lines 116. Note that the scan lines 115 may be referred to as the first, second, . . . , m-th scan lines 115 when it is necessary to discriminate any one scan line 115 of the plurality of scan lines 115 from the other scan lines 115. This also applies to the data lines 116. The "m×n" pixels 14 form the display region 15. When a pixel 14 in the i-th row and j-th column of the display region 15 is to be discriminated from the other pixels 14, that pixel 14 is referred to as the pixel 14(*i, j*).

The scan line driving circuit 16 outputs scan signals Y for sequentially and exclusively selecting each scan line 115 of the "m" scan lines 115. The scan signals Y may be, for example, signals that are sequentially and exclusively set at the H (high) level. The data line driving circuit 17 outputs data signals X. The data signals X are signals that supply data voltages for causing the pixels 14 to change their gray levels. The data line driving circuit 17 outputs a data signal indicating a data voltage corresponding to the relevant pixel 14 that is located in a row that is selected by a scan signal. The scan line driving circuit 16 and the data line driving circuit 17 are controlled by the display controller 20.

Figure 4:
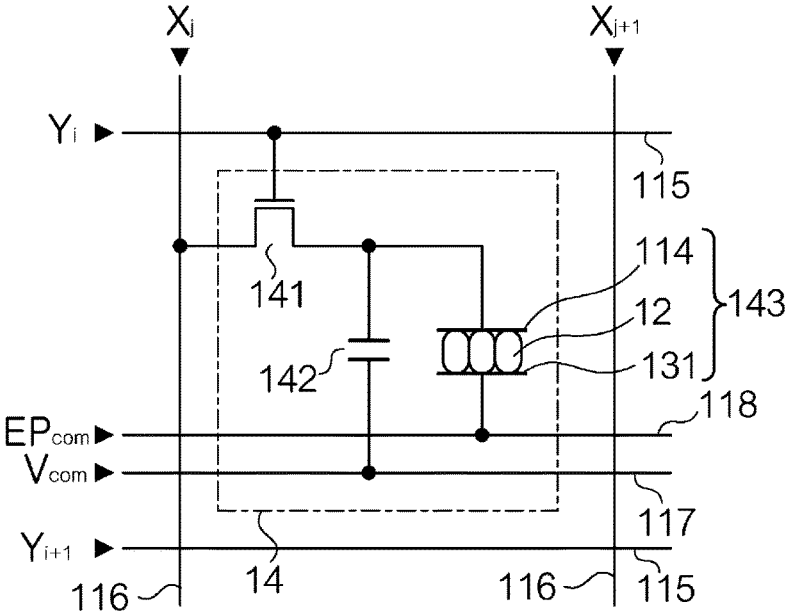
FIG. 4 is a diagram showing an equivalent circuit of a pixel 14.

FIG. 4 is a diagram showing an equivalent circuit of each pixel 14. The pixels 14 each have a transistor 141, a capacitor 142, and an electrophoretic element 143. The electrophoretic element 143 has the corresponding pixel electrode 114, the electrophoretic layer 12, and the common electrode 131. The transistor 141 is an example of a switch that controls writing of data to the pixel electrode 114, and may be, for example, an re-channel TFT (thin film transistor). The gate, source, and drain of the transistor 141 are connected to the corresponding scan line 115, the corresponding data line 116, and the pixel electrode 114, respectively. When a scan signal (non-selective signal) at the L (low) level is input to the gate, the source and the drain of the transistor 141 are insulated from each other. When a scan signal (selective signal) at the H level is input to the gate, an electrical connection is established between the source and the drain of the transistor 141, allowing a data voltage to be written to the pixel electrode 114. Also, one electrode of the capacitor 142 is connected to the drain of the transistor 141, and the other electrode of the capacitor 142 is connected to a reference potential Vcom via a line 117. The capacitor 142 holds an electric charge corresponding to the data voltage. Each of the pixels 14 is provided with one pixel electrode 114, and the pixel electrodes 114 oppose the common electrode 131. The common electrode 131 is shared by all of the pixels 14, and a potential EPcom is given to the common electrode 131 via a line 118. The electrophoretic layer 12 is sandwiched between the pixel electrodes 114 and the common electrode 131. The electrophoretic element 143 is formed by the pixel electrode 114, the electrophoretic layer 12, and the common electrode 131. A voltage corresponding to the potential difference between the pixel electrode 114 and the common electrode 131 is applied to the electrophoretic layer 12. In each of the microcapsules 121, the electrophoretic particles move in accordance with voltages that are applied to the electrophoretic layer 12, thereby producing various gray levels. If the potential of the pixel electrode 114 is positive (e.g., +15 V) with respect to the potential EPcom of the common electrode 131, the negatively charged white electrophoretic particles move toward the pixel electrode 114, and the positively charged black electrophoretic particles move toward the common electrode 131. At this time, when the electro-optical panel 10 is seen from the side of the second substrate 13, the pixel 14 looks black. If the potential of the pixel electrode 114 is negative (e.g., −15 V) with respect to the potential EPcom of the common electrode 131, the positively charged black electrophoretic particles move toward the pixel electrode 114, and the negatively charged white electrophoretic particles move toward the common electrode 131. At this time, the pixel 14 looks white.

Note that in the following description, a unit time period from when the scan line driving circuit 16 selects the first scan line 115 to when the selection of the m-th scan line 115 is finished will be called a "frame". Each scan line 115 is selected once in each single frame, and a data signal is supplied once in each single frame to each pixel 14.

Next, an overview of the method of driving the electro-optical panel 10 will be described. In this example, the time length of a single frame is shorter than the response time of the electrophoretic element 143. The response time of the electrophoretic element 143 refers to a time that is required for the electrophoretic element 143 to change its optical state (e.g., relative lightness) from a reference value (e.g., 10%) to another reference value (e.g., 90%) when a predetermined voltage (e.g., +15 V) is applied to the electrophoretic element 143. That is to say, voltage application for only a single frame cannot achieve a gray level transition from the lowest luminance to the highest luminance. Thus, in order to achieve a transition from a current gray level to a desired gray level, voltage application is performed for a plurality of frames. The voltage that is applied to the electrophoretic element 143 is any of a positive voltage (for example, the potential of the pixel electrode 114 is +15 V with respect to the potential EPcom of the common electrode 131), a negative voltage (for example, the potential of the pixel electrode 114 is −15 V with respect to the potential EPcom of the common electrode 131), and a zero voltage (the potential of the pixel electrode 114 is equal to the potential EPcom of the common electrode 131). There is a plurality of patterns (sequences) of combinations (permutations, to be mathematically precise) of voltages that are applied in respective frames for achieving a transition from the current gray level to a desired gray level. A voltage application pattern can be considered as indicating temporal changes in the application voltage, and in that sense, each voltage application pattern will be called a "drive waveform" in the following description.

FIG. 5 illustrates a drive waveform table. The drive waveform table shows information (patterns) on voltages to be applied in a plurality of frames in order to change the display of a pixel 14 from a current gray level to the next gray level. The drive waveform table illustrated in FIG. 5 assumes a case where all the possible gray level transitions are performed by performing voltage application for four frames. In FIG. 5, "+", "−", and "0" indicate a positive voltage, a negative voltage, and a zero voltage, respectively.

FIG. 5 shows only a single drive waveform table, but in an embodiment of the invention, a plurality of different drive waveform tables are used to drive the electro-optical panel 10. The plurality of drive waveform tables are individually designed for different purposes of achieving a high rewrite speed, reducing afterimages, and so on. Note that in the following description, one or more drive waveform tables may be called a "drive waveform group". Also, in the following description, a drive waveform group that is designed for a certain purpose will be referred by the term "mode". For example, a drive waveform for high-speed rewriting would be referred to as the "drive waveform of a first mode", and a drive waveform for reducing afterimages would be referred to as the "drive waveform of a second mode".

Driving of the electro-optical panel 10 is affected by an environmental factor (e.g., temperature), and thus, for each mode, there is a plurality of drive waveform tables suited to a plurality of environmental factors. For example, in accordance with the scene of usage and a given environmental factor, one drive waveform table selected from the plurality of drive waveform tables is used. FIG. 5 shows such a selected drive waveform table belonging to a certain mode and corresponding to a certain environmental factor.

From the information on application voltages, the information being recorded in a single drive waveform table that is selected in accordance with the drive waveform mode and the environmental factor, information on an application voltage that is suited to the current gray level, the next gray level, and the frame number is used. In FIG. 5, for example, if the current gray level is dark gray (DG), the next gray level is light gray (LG), and the frame number is 2, a negative voltage is output as the data voltage. That is to say, in this example, it can be considered that the voltage to be applied in each frame depends on the following five parameters: the drive waveform mode, the environmental factor (temperature), the current gray level, the next gray level, and the frame number. Note that for the sake of simplicity of description, an example in which common drive waveforms are used irrespective of the environmental factors will be described below.

FIGS. 6A and 6B are diagrams each illustrating a gray level transition of the electrophoretic element 143 due to a drive waveform. In FIGS. 6A and 6B, two drive waveforms are illustrated that individually change the gray level of the electrophoretic element 143 that is capable of displaying four gray levels, white (Wt), light gray (LG), dark gray (DG), and black (Bk), from DG to Wt. The two drive waveforms differ from each other in the total number of frames. FIG. 6A shows the drive waveform that achieves the gray level transition from DG to Wt in four frames, and FIG. 6B shows the drive waveform that achieves the gray level transition from DG to Wt in twelve frames. The drive waveform in FIG. 6A is designed with the aim of achieving a high rewrite speed. The drive waveform in FIG. 6B is designed with the aim of reducing afterimages.

FIG. 7 is a diagram for explaining a problem with the method of driving the electro-optical panel 10. Here, an example is shown in which within, for example, a rectangular region in the display region 15 of the electro-optical panel 10, rewriting is performed to change a state in which an ellipse in dark gray (DG) is drawn in the rectangle in light gray (LG) to a state in which the entire rectangular region is white (Wt). Here, within the rectangular region in which the rewriting is performed, a common drive waveform table (drive waveform group) is used. At this time, depending on the design of the drive waveforms, the grayscale may be inverted during rewriting (the region that was in light gray (LG) before rewriting may become darker than the region that was in dark gray (DG)). For example, in the case where an image subjected to anti-aliasing is displayed, it may look strange to a user if the grayscale is inverted as described above, even though rewriting is in progress.

The electronic apparatus 1000 to which the invention is applied addresses this problem. Specifically, the electronic apparatus 1000 rewrites, within a region to be rewritten, an image using drive waveforms that are contained in drive waveform tables that are determined for respective key colors. "Key colors" as used herein refer to gray levels that are designated from the gray levels that can be produced by the electro-optical panel 10. In this embodiment, for example, different drive waveform tables are used for different pixels 14 whose gray levels before rewriting are light gray (LG) and black (Bk), respectively.

2. Configuration

Figure 8:
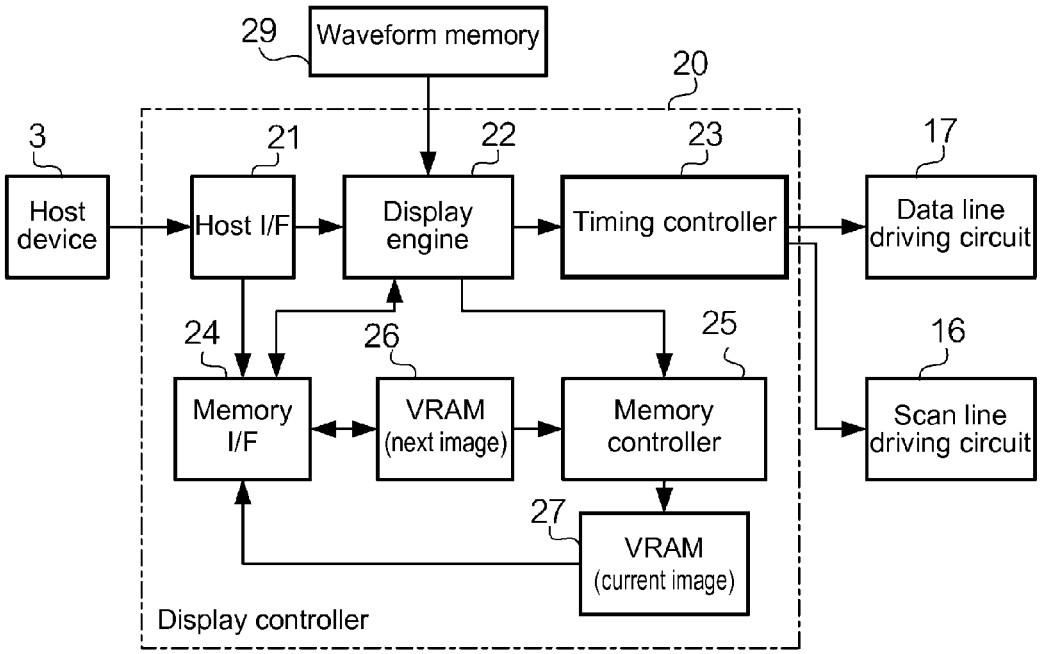
FIG. 8 is a diagram illustrating the configuration of a display controller 20.

FIG. 8 is a diagram illustrating the configuration of the display controller 20. In FIG. 8, in addition to the display controller 20, related hardware is also shown. The display controller 20 has a host I/F 21, the display engine 22, a timing controller 23, a memory I/F 24, a memory controller 25, a VRAM 26, and a VRAM 27.

The host I/F 21 accepts a signal instructing that an image should be rewritten from the host device 3 and, in accordance with the accepted signal, instructs the display engine 22 to rewrite the image.

The display engine 22 generates a signal for driving the electro-optical device 1 in accordance with image data. The details of the display engine 22 will be described later.

The timing controller 23 adjusts the timing of a signal that is output from the display engine 22 and outputs a control signal to the scan line driving circuit 16 and the data line driving circuit 17.

The VRAM 26 is an example of a second storage section (second storage unit) of the invention, and is a storage that stores first image data indicating the next image, or image after rewriting. The VRAM 27 is an example of a third storage section (third storage unit) of the invention, and is a storage that stores second image data indicating the current image, or image before rewriting. The "current image" as used herein refers to an image before rewriting during image rewriting.

The memory I/F 24 is an interface that mediates access to (reading/writing of data from/to) the VRAM 26 and the VRAM 27.

When rewriting of an image is completed, the memory controller 25 writes (i.e., copies) data on the next image, which is stored in the VRAM 26, to the VRAM 27.

A waveform memory 29 includes a storage that stores a plurality of drive waveform tables and a controller of that storage. When the five parameters, that is, the drive waveform mode, the environmental factor (temperature), the current gray level, the next gray level, and the frame number are given from the display engine 22, the waveform memory 29 outputs information on an application voltage corresponding to these parameters to the display engine 22. Note that the waveform memory 29 is an example of a first storage section (first storage unit) of the invention and may also be provided in the display engine 22.

Figure 9:
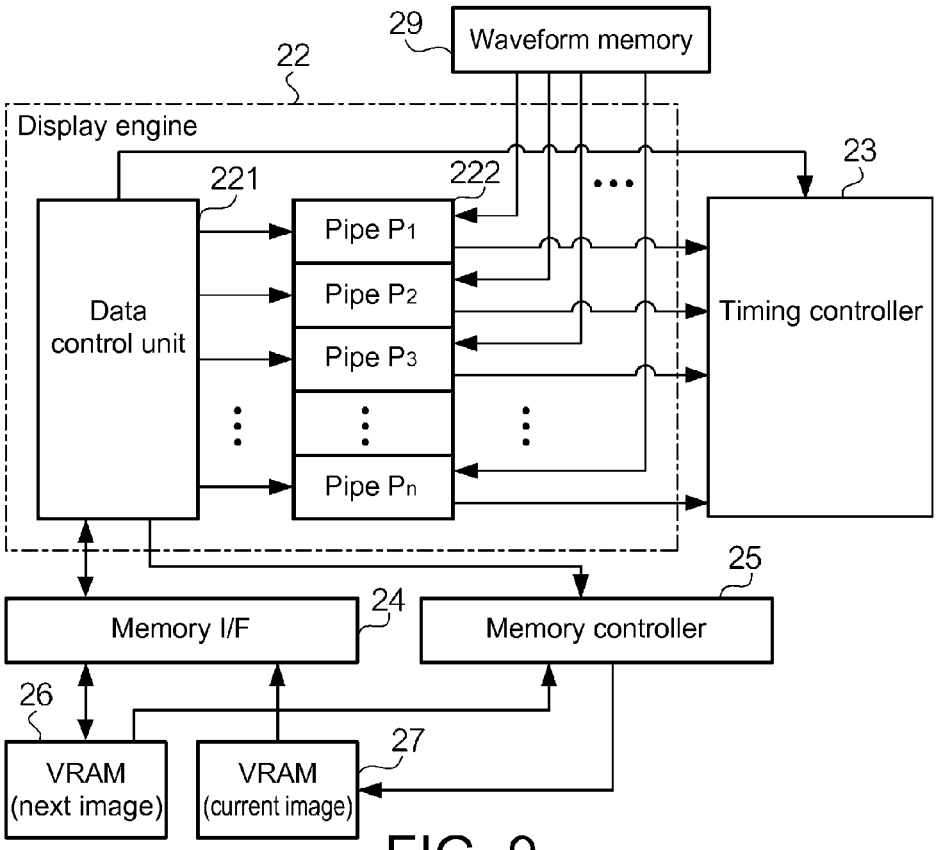
FIG. 9 is a diagram illustrating the configuration of a display engine 22.

FIG. 9 is a diagram illustrating the configuration of the display engine 22. In FIG. 9, in addition to the display engine 22, related hardware is also shown. The display engine 22 is an example of an output section (output unit) of the invention and has a data control unit 221 and a pipe 222.

The pipe 222 has "n" pipes $P_1$ to $P_n$. The "n" pipes $P_1$ to $P_n$ are examples of sub-output sections that perform processing independently.

The data control unit 221 reads image data from the VRAM 26 and the VRAM 27, and outputs the read data for each pixel 14 to a corresponding pipe. That is to say, the data control unit 221 is an example of an acquiring section (acquiring unit) that acquires image data.

A region on the electro-optical panel 10 and a key color are assigned to each pipe $P_1$ to $P_n$. The data control unit 221 selects one of the pipes $P_1$ to $P_n$ in accordance with the position of a pixel 14 and the gray level value of that pixel 14. Each pipe $P_1$ to $P_n$ reads information on application voltages corresponding to the region on the electro-optical panel 10 and the key color from the waveform memory 29, and outputs a signal to the timing controller 23, the signal indicating the read information on the application voltages.

3. Operation

Figure 10:
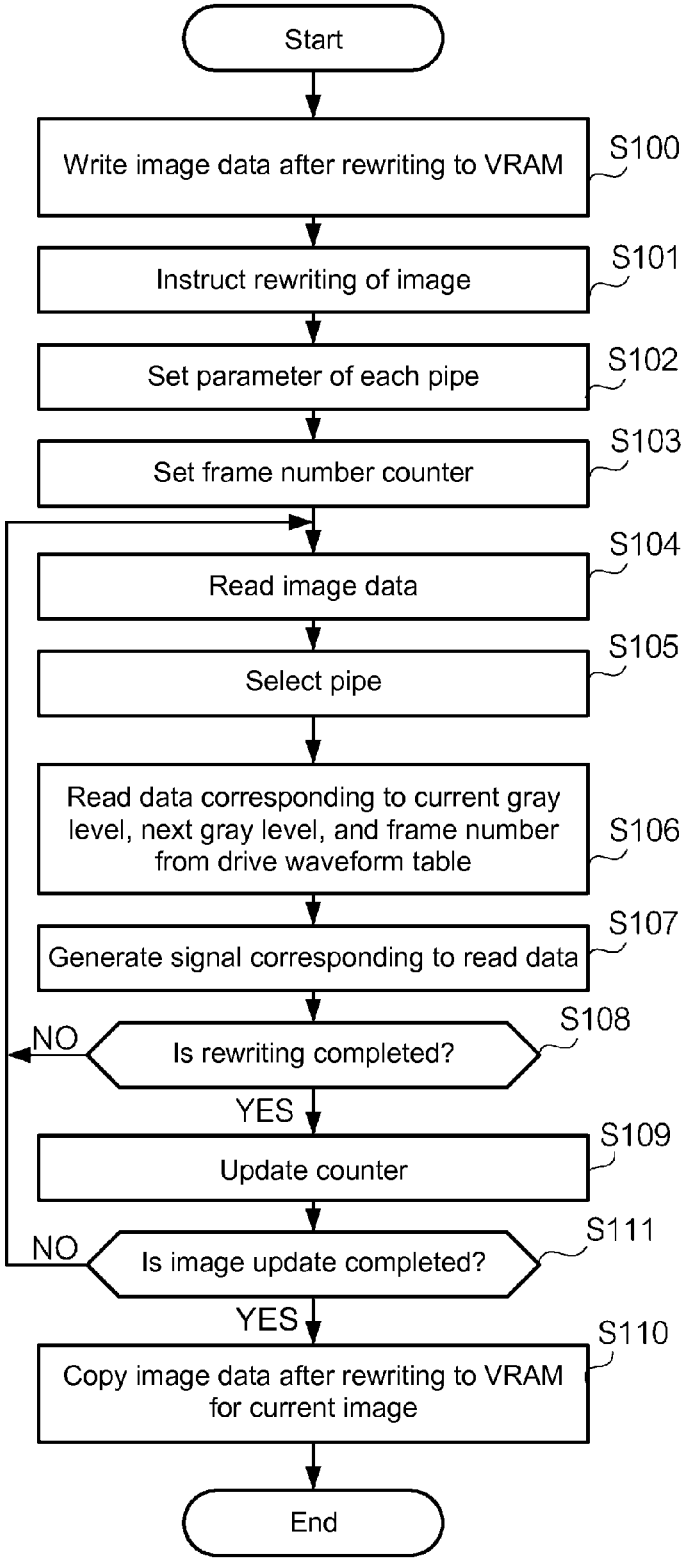
FIG. 10 is a flowchart showing the operation of the electronic apparatus 1000.

FIG. 10 is a flowchart showing the operation of the electronic apparatus 1000. In the electronic apparatus 1000, the CPU 31 executes a program, and the flow of FIG. 10 is started when a predetermined event occurs during the execution of the program.

In step S100, the CPU 31 of the host device 3 writes image data indicating an image after rewriting to the VRAM 26 via the memory I/F 24. In step S101, the CPU 31 instructs the display controller 20 to rewrite an image. More specifically, the CPU 31 outputs an image rewrite instruction (update instruction) to the display engine 22 via the host I/F 21. This rewrite instruction contains all of the pieces of information (1) to (5) below:

(1) Region in which an image is to be updated;
(2) Drive waveform mode to be used;
(3) Pipe number ($P_1$ to $P_n$) of a pipe to be used;
(4) Key color; and
(5) Number of offset frames.

In this embodiment, the region in which an image is to be updated is a rectangular region. The rectangular region is specified by information indicating a reference point (e.g., top-left vertex) and the size (e.g., width and height) of the rectangular region. The drive waveform modes and the pipes $P_1$ to $P_n$ are specified by identification numbers that are assigned in advance. The key colors are specified by gray level values. The number of offset frames will be described later.

FIG. 11 is a diagram illustrating an image after rewriting. Here, two regions A and B of the display region 15 are to be rewritten. An image of the region A is composed of pixels 14 of two colors, light gray (LG) and dark gray (DG). An image of the region B is composed of pixels 14 of three colors, light gray (LG), dark gray (DG), and black (Bk). Therefore, five pipes are used here. In order to perform processing using the five pipes, the CPU 31 outputs five rewrite instructions to the display engine 22. The five rewrite instructions will be called "instructions C1 to C5".

FIG. 12 is a table illustrating designation of the regions, pipes, and key colors of the instructions C1 to C5. In addition to these, the drive waveform modes and the numbers of offset frames are also designated by the rewrite instructions; however, those parameters are omitted from the table here. Note that if even one of the above-described pieces of information (1) to (5) is different, a different drive waveform table would be used. Thus, it is conceivable that if at least portions of the respective regions selected for the plurality of pipes $P_1$ to $P_5$ overlap, a plurality of drive waveform tables would correspond to a predetermined key color. In such a case, there would be an additional need to select which of the pipes $P_1$ to $P_5$ is to be used with respect to that predetermined key color. For this reason, it is also possible to prevent the regions associated with the pipes $P_1$ to $P_5$ from overlapping. A situation in which the selection of which of the plurality of pipes $P_1$ to $P_5$ is to be used is required can be avoided by preventing the regions that are designated for the respective pipes $P_1$ to $P_5$ from overlapping.

Referring again to FIG. 10, in step S102, the data control unit 221 sets the parameters (regions and key colors) corresponding to the respective pipes $P_1$ to $P_5$. The data control unit 221 has registers for storing the region and key color for each pipe $P_1$ to $P_5$. The data control unit 221 writes the parameters (FIG. 12) that are indicated by the received rewrite instructions to the registers corresponding to the respective pipes $P_1$ to $P_5$.

In step S103, the data control unit 221 sets counters for counting the frame numbers of the respective pipes $P_1$ to $P_5$. The counters are used to indicate what number frame the current frame corresponds to, of the total number of frames obtained by adding the number of offset frames and the number of frames of the drive waveform. Each of the pipes $P_1$ to $P_5$ has a register that can be used as the counter. The data control unit 221 writes a value that is determined using the information specifying the drive waveform mode and the number of offset frames, the information being contained in a rewrite instruction, to the predetermined register of the corresponding pipe $P_1$ to $P_5$. Now, the offset will be described before the description of the value to be written to the predetermined register.

FIG. 13 is a diagram illustrating a drive waveform offset. "Offset" as used herein refers to the number of waiting frames between the receipt of a rewrite instruction and the start of voltage application due to a drive waveform. FIG. 13 shows an example in which the pipe $P_1$ uses a drive waveform mode 1, and the pipe $P_2$ uses a drive waveform mode 2. The number of frames of the drive waveform mode 1 is seven, and the number of frames of the drive waveform mode 2 is five. In the pipe $P_1$, voltage application due to the drive waveform mode 1 is started immediately after the receipt of the rewrite instruction, whereas in the pipe $P_2$, voltage application due to the drive waveform mode 2 is started after an offset of five frames (i.e., the offset of the pipe $P_1$ is zero). The offset can be set for each pipe. Although not shown, for example, an offset that is different from the offset of the pipe $P_2$ may be set for the pipe $P_3$.

There is a possibility that the use of an offset may prolong the time it takes for rewriting to be completed. In the example in FIG. 13, if the offset of the pipe $P_2$ is zero, rewriting is completed in seven frames; however, an offset is used, and thus it takes ten frames for rewriting to be completed. Despite the demerit as described above, the use of an offset can reduce the strangeness that has been described using FIG. 7.

Referring again to FIG. 10, setting of the counter in step S103 will be described. The data control unit 221 writes a value obtained by adding an offset to the number of frames of a designated drive waveform mode to the counter of a corresponding pipe as an initial value. In the example in FIG. 13, "7" is written to the counter of the pipe $P_1$, and "10" is written to the counter of the pipe $P_2$.

In step S104, the data control unit 221 reads image data from the VRAM 26 and the VRAM 27. Specifically, the data control unit 221 reads data NI regarding the next image from the VRAM 26 and data CI regarding the current image from the VRAM 27. The image data is read in a predetermined unit (for example, row-by-row).

In step S105, the data control unit 221 selects a pipe to process the data out of the pipes $P_1$ to $P_5$. Selection of a pipe from the pipes $P_1$ to $P_5$ is performed for each pixel 14. The data control unit 221 selects a pipe from the pipes $P_1$ to $P_5$ in accordance with the position and the gray level value (in this example, gray level value that is indicated by the data NI) of a target pixel 14. For example, if the target pixel 14 is located in the region A, and the gray level value indicated by the data NI is light gray (LG), the pipe $P_1$ is selected. The data control unit 221 outputs the data (data CI and data NI) on the target pixel 14 to the selected pipe $P_1$.

The pipes $P_1$ to $P_5$ each access the waveform memory 29 and read information on an application voltage corresponding to the drive waveform mode, the current gray level, the next gray level, and the frame number that are designated (step S106). Here, during an offset period (for example, first to fifth frames with respect to the pipe $P_2$ in FIG. 13), each pipe $P_1$ to $P_5$ performs processing assuming that information indicating the zero voltage has been read from the waveform memory 29. Each pipe $P_1$ to $P_5$ generates a signal corresponding to the information on the application voltage, which has been read from the waveform memory 29, and outputs the signal to the timing controller 23 (step S107). The processing of steps S104 to S107 is sequentially performed with respect to all of the pixels 14 in the display region 15 (step S108).

The timing controller 23 adjusts the timing of the signals output from the pipes $P_1$ to $P_5$, and outputs the signals to the data line driving circuit 17. The timing controller 23 has a buffer (not shown) of a predetermined size (for example, size corresponding to a single row). Data indicated by the signals output from the pipes $P_1$ to $P_5$ is sequentially accumulated in the buffer. The data accumulated in the buffer is output to the data line driving circuit 17 in synchronization with scanning of the scan lines 115 that is performed by the scan line driving circuit 16.

In step S108, the data control unit 221 judges whether processing of a single frame is completed. It is possible to recognize whether the processing of a single frame is completed from the position of the signal in an effective scan line 115. As described above, if processing with respect to all of the pixels 14 in the display region 15 is not yet finished (if processing of a single frame is not yet finished), the process returns to step S104. If the processing is finished, the process proceeds to step S109.

In step S109, the data control unit 221 updates the counters. Specifically, the data control unit 221 decrements the counter value of each of the pipes $P_1$ to $P_5$ by 1. When the counters are updated, the process proceeds to judgement of whether updating of the image is finished (step S111).

In step S111, the judgement of whether updating of the image is finished is made based on the counter values of the respective pipes $P_1$ to $P_5$. Specifically, if the counter values of all of the pipes $P_1$ to $P_5$ are zero, the data control unit 221 judges that rewriting is completed. If the counter value of any pipe is not zero, the data control unit 221 judges that rewriting is not yet completed. If it is judged that rewriting is completed (step S111: YES), the data control unit 221 instructs the memory controller 25 to transfer data, and the process proceeds to step S110. If it is judged that rewriting is not yet completed (step S111: NO), the process returns to step S104.

When instructed to transfer data by the data control unit 221, the memory controller 25 copies data on the next image that is stored in the VRAM 26 to the VRAM 27. The data on the next image that is stored in the VRAM 27 is thus equal to the data on the current image that is stored in the VRAM 26, and rewriting of the image is finished.

Figures 15A, 15B, 15C:
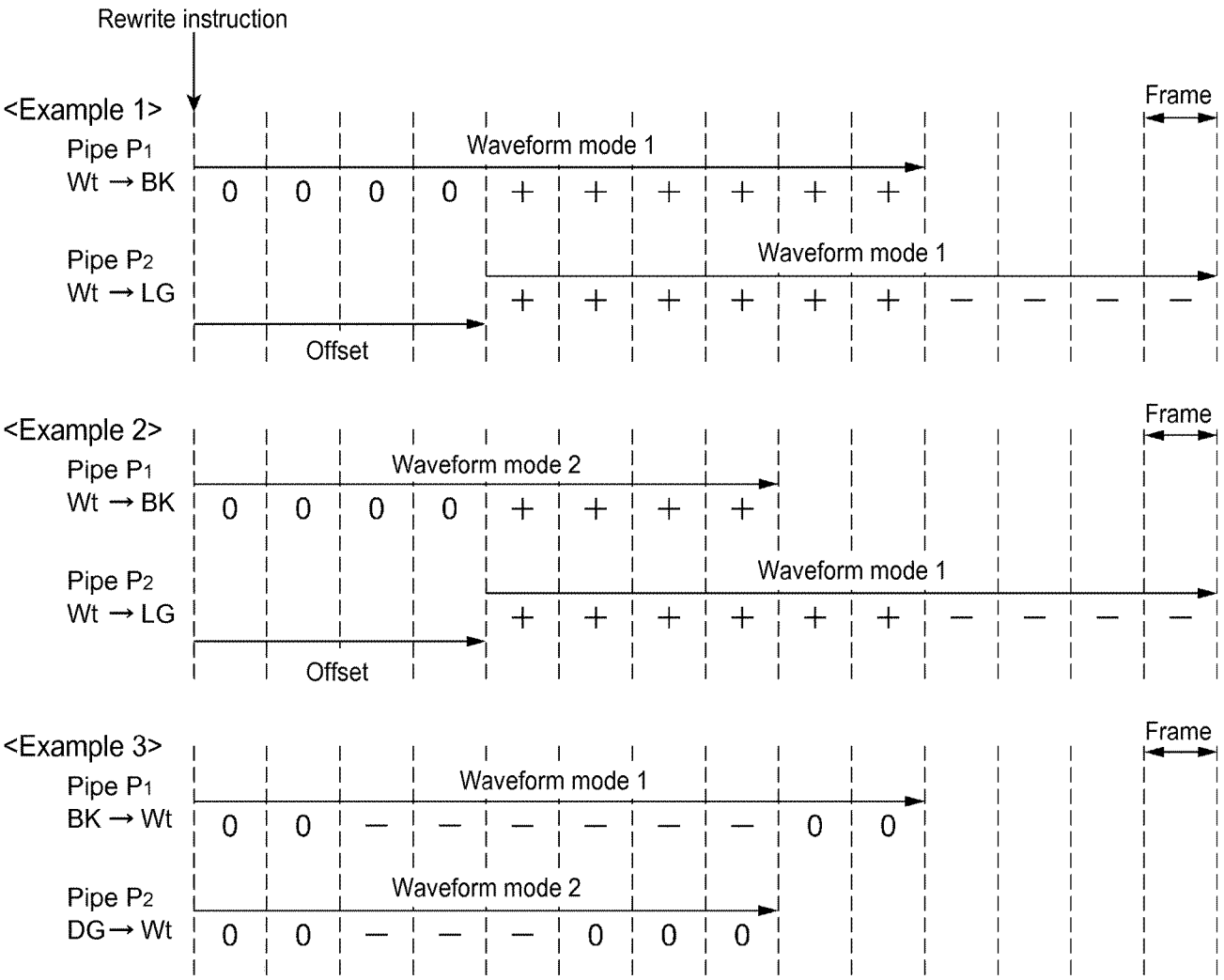
FIGS. 15A to 15C are diagrams showing how a drive waveform mode is selected.
Figure 16:
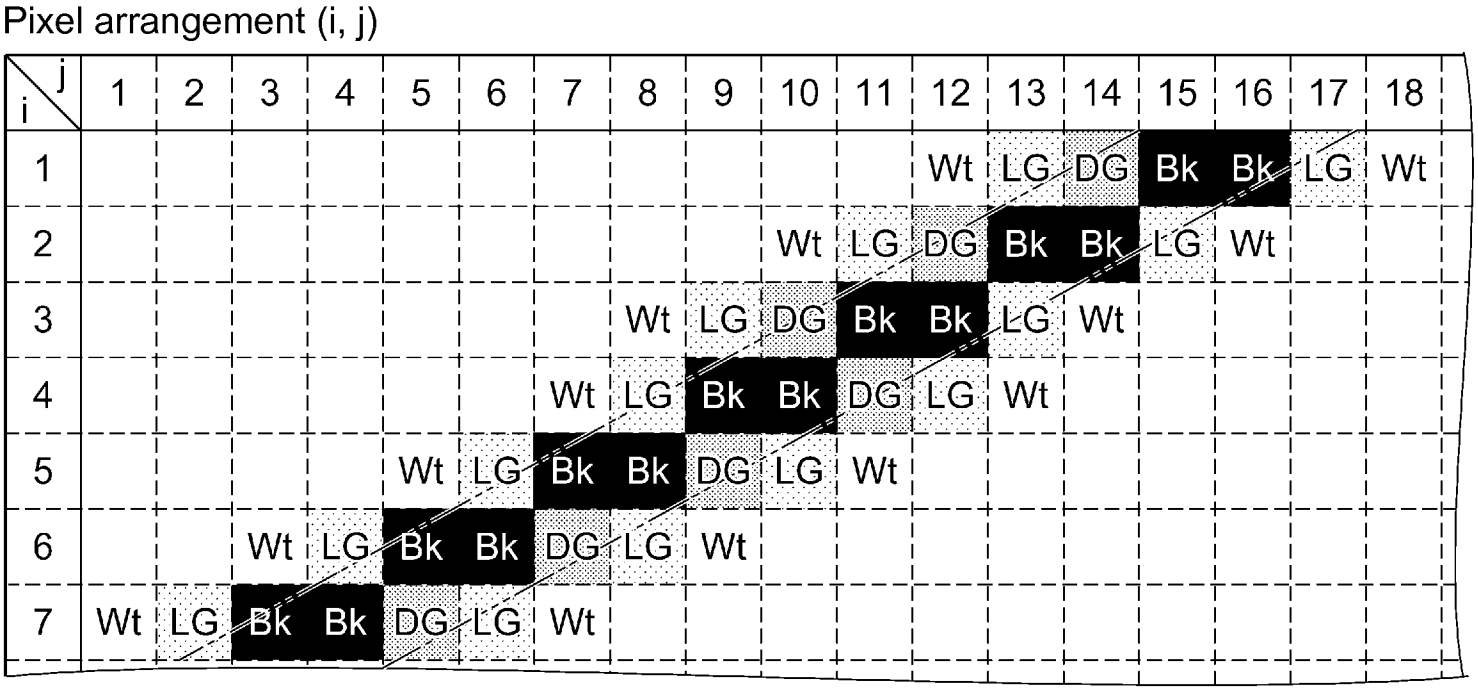
FIG. 16 is a diagram showing an example of anti-aliasing.

Next, selection of a drive waveform mode and a specific effect will be described with reference to FIGS. 14A to 16. FIGS. 14A and 14B are tables showing examples of drive waveform modes having different voltage application patterns, FIGS. 15A to 15C are diagrams showing how a drive waveform mode is selected, and FIG. 16 is a diagram showing an example of anti-aliasing.

The drive waveform modes according to the invention, which are a plurality of pattern groups of voltage application for changing the optical states of the respective pixels 14 to designated gray levels, are not limited to the drive waveform table previously shown in FIG. 5, and it is conceivable to use a plurality of drive waveform modes. Examples of the plurality of drive waveform modes include a drive waveform mode for high-speed rewriting, a drive waveform mode for reducing afterimages, and the like as described above. Also, the drive waveform modes are designed taking the display characteristics (response speed, relative lightness, temperature characteristics, and the like) of the electrophoretic element 143 of the electro-optical panel 10 into account.

Examples of the drive waveform modes include a drive waveform mode 1 (hereinafter simply called the "waveform mode 1") shown in FIG. 14A and a drive waveform mode 2 (hereinafter simply called the "waveform mode 2") shown in FIG. 14B.

As shown in FIG. 14A, in the waveform mode 1, information (patterns) on voltage application for changing the display of a pixel 14 from a current gray level to the next gray level is stated, and the number of frames is set at ten frames 0 to 9. According to the waveform mode 1, for example, in the case where the display of a pixel 14 whose current gray level is black (Bk), which has the lowest relative lightness, is to be changed to the next gray level, white (Wt), which has the highest relative lightness, "0", that is, a reference voltage is applied in frames 0 and 1, then "−", that is, a negative voltage with respect to the reference voltage is applied in frames 2 to 7, and furthermore, "0", that is, the reference voltage is applied in frames 8 and 9. That is to say, a transition from black (Bk) to white (Wt) is achieved by applying the negative voltage for six frames. Also, in the case where the display of a pixel 14 whose current gray level is black (Bk), which has the lowest relative lightness, is to be changed to the next gray level, dark gray (DG), which is an intermediate gray level, "−", that is, a negative voltage with respect to the reference voltage is applied in frames 0 and 1, and then "0", that is, the zero voltage (reference voltage) is applied in frames 2 to 9. That is to say, a transition from black (Bk) to dark gray (DG) is achieved by applying the negative voltage for two frames. In the case where black (Bk) is to be changed to light gray (LG), a negative voltage is applied in four frames 0 to 3. In other words, in the case where the state of the lowest relative lightness is to be changed to an intermediate gray level, the number of frames for which a negative voltage is applied is adjusted.

On the other hand, according to the waveform mode 1, in the case where the display of a pixel 14 whose current gray level is white (Wt), which has the highest relative lightness, is to be changed to the next gray level, black (Bk), which has the lowest relative lightness, "0", that is, the zero voltage is applied in frames 0 to 3, and then "+", that is, a positive voltage is applied in frames 4 to 9. That is to say, a transition from white (Wt) to black (Bk) is achieved by applying the positive voltage for six frames. Also, in the case where the display of a pixel 14 whose current gray level is white (Wt), which has the lowest relative lightness, is to be changed to the next gray level, light gray (LG), which is an intermediate gray level, "+", that is, a positive voltage is applied in frames 0 to 5, and then "−", that is, a negative voltage is applied in frames 6 to 9. Similarly, in the case where the display of a pixel 14 whose current gray level is white (Wt), which has the highest relative lightness, is to be changed to the next gray level, dark gray (DG), which is an intermediate gray level, "0", that is, the reference voltage is applied in frames 0 and 1, then "+", that is, a positive voltage is applied in frames 2 to 7, and "−", that is, a negative voltage is applied in frames 8 and 9. That is to say, in the case where white (Wt) is to be changed to light gray (LG) or dark gray (DG), which are intermediate gray levels, a temporary transition to black (Bk) is performed before a transition to the relevant intermediate gray level (LG or DG) is performed.

As shown in FIG. 14B, in the waveform mode 2, information (patterns) on voltage application for changing the display of a pixel 14 from s current gray level to the next gray level is stated, and the number of frames is set at eight frames 0 to 7. Also, while four colors, black (Bk), dark gray (DG), light gray (LG), and white (Wt), are set as the current gray level, two colors, black (Bk) and white (Wt), are set as the next gray level. In other words, no information (patterns) on voltage application for changing black (Bk) or white (Wt) to an intermediate gray level is prepared.

Now, an example of anti-aliasing will be described with reference to FIG. 16. FIG. 16 is a plan view showing an arrangement of pixels 14 in the display region 15 of the electro-optical panel 10 in an enlarged manner. The pixels 14 each have, for example, a square shape when viewed from above. Note that the shape of each pixel 14 when viewed from above is not limited to a square and may also be a rectangle whose length in the column direction is longer than the length in the row direction.

In the display region 15 as described above, if a straight line extending in the row direction or the column direction is to be displayed, it goes without saying that a straight line without a bend can be displayed by changing the pixels 14 that are designated by image data and lined up in the row direction or the column direction from white (Wt) to black (Bk). However, as shown in FIG. 16, if it is desired to display an oblique line (indicated in phantom lines in the drawing) that is inclined from the row direction and the column direction, simply changing the pixels 14 in the range of the width of that oblique line from white (Wt) to black (Bk) would result in creation of steps in the peripheries (edges) of the oblique line, the steps being caused by the arrangement pitch of the pixels 14. An example of image processing for apparently alleviating these steps is anti-aliasing that changes the pixels 14 that are located on the peripheries (edges) of the oblique line from white (Wt) to an intermediate gray level (LG or DG). It is possible to display an apparently smooth oblique line by applying anti-aliasing, even though the peripheries (edges) thereof are slightly blurred. In this embodiment, two pixels 14 in an oblique line to be displayed that are adjacent to each other in the row direction are displayed in black (Bk), and pixels 14 that are respectively adjacent to the two pixels 14, which are displayed in black (Bk), in the row direction are each displayed in an intermediate gray level (LG or DG). It goes without saying that anti-aliasing is not only applicable to oblique lines but also applicable to display of figures, characters, and the like that are defined by combinations of oblique lines and curved lines. Also, various algorithms are applied to the method of setting an intermediate gray level with respect to a pixel 14 that is subjected to anti-aliasing. An example thereof is a method of determining the intermediate gray level of a pixel 14 that is crossed by the above-described periphery (edge) based on the ratio of the area of a portion that is originally desired to be displayed to the area of that pixel 14.

As shown in FIG. 16, in the case where, for example, an oblique line that is subjected to anti-aliasing is actually displayed, it is preferable that display of black (Bk) and display of an intermediate gray level (LG or DG) appear substantially simultaneously. For example, if display of the intermediate gray level (LG or DG) appears earlier than display of black (Bk), a hollow oblique line in which a central portion of the oblique line has lower lightness than a peripheral portion is displayed in midstream of the processing, and the appearance thereof looks strange.

As a method of eliminating such strangeness in terms of appearance, as shown in Example 1 in FIG. 15A, when a rewrite instruction is issued, the pipe $P_1$ selects the waveform mode 1 and outputs application voltages for changing white (Wt) to black (Bk). Thus, with respect to a pixel 14 that is designated for the pipe $P_1$, "0", that is, the zero voltage is applied in frames 0 to 3, and "+", that is, a positive voltage is applied in frames 4 to 9, thereby causing the pixel 14 to gradually decrease its relative lightness and transition to black (Bk). On the other hand, the pipe $P_2$ selects the waveform mode 1 after an offset of four frames and outputs application voltages for changing white (Wt) to light gray (LG), which is an intermediate gray level. Thus, a pixel 14 that is designated for the pipe $P_2$ changes to light gray (LG) after a delay from the transition of the pixel 14 that is designated for the pipe $P_1$.

In Example 1 in FIG. 15A, the pipe $P_1$ and the pipe $P_2$ select the same waveform mode 1, but as in Example 2 in FIG. 15B, even a method in which the pipe $P_1$ selects the waveform mode 2, and the pipe $P_2$ selects the waveform mode 1 after an offset of four frames can solve the problem of the strangeness caused by display of a hollow oblique line as described above. Specifically, in Example 2 in FIG. 15B, with respect to the pixel 14 that is designated for the pipe $P_1$, "0", that is, the zero voltage is applied in frames 0 to 3, and "+", that is, a positive voltage is applied in frames 4 to 7, thereby causing the pixel 14 to gradually decrease its relative lightness and transition to black (Bk). That is to say, the pixel 14 that is designated for the pipe $P_1$ is changed to black (Bk) earlier than that in Example 1, and in the course of this transition, the relative lightness of that pixel 14 becomes lower than the relative lightness of the pixel 14 that is designated for the pipe $P_2$, and thus the occurrence of the phenomenon of the above-described hollow line is prevented.

It is conceivable that the above-described hollow line phenomenon occurs not only when an image that is subjected to anti-aliasing is displayed but also when an image that is subjected to anti-aliasing is erased (rewritten). In such a case, for example, a waveform mode selecting method of Example 3 shown in FIG. 15C can be used.

As shown in FIG. 15C, according to the waveform mode selecting method of Example 3, when a rewrite instruction is issued, the pipe $P_1$ selects the waveform mode 1 and outputs application voltages for changing black (Bk) to white (Wt). Thus, with respect to a pixel 14 that is designated for the pipe $P_1$, "0", that is, the zero voltage is applied in frames 0 and 1, "−", that is, a negative voltage is applied in frames 2 to 7, thereby causing the pixel 14 to gradually increase its relative lightness and transition to white (Wt), and then, "0", that is, the zero voltage is applied in frames 8 and 9. Meanwhile, the pipe $P_2$ selects the waveform mode 2 and outputs application voltages for changing dark gray (DG) to white (Wt). With respect to a pixel 14 that is designated for the pipe $P_2$, "0", that is, the zero voltage is applied in frames 0 and 1, and "−", that is, a negative voltage is applied in frames 2 to 4, thereby causing the pixel 14 to increase its relative lightness and transition to white (Wt). That is to say, the pixel 14 that is designated for the pipe $P_2$ is changed to white (Wt) earlier than the pixel 14 that is designated for the pipe $P_1$, and thus the occurrence of the hollow line phenomenon is prevented as well.

To summarize, it is preferable to prepare a plurality of voltage application patterns for a waveform mode and select and combine waveform modes from a plurality of waveform modes so that if there are a first pixel and a second pixel that are adjacent to each other, the first pixel having low relative lightness in the next image (or current image) and the second pixel having higher relative lightness than the relative lightness of the first pixel in the next image (or current image), the relative lightness of the second pixel can be prevented from falling below the relative lightness of the adjacent first pixel in the course of transitions of the first and second pixels.

4. Variations

The invention is not limited to the embodiment described above, and various variations can be implemented. Hereinafter, some variations will be described. It is also possible that two or more of the following variations are used in combination.

4-1. Variation 1

The display engine 22 may not necessarily be required to have a plurality of pipes $P_1$ to $P_n$. For example, the display engine 22 having only a single processing unit (pipe) may define a correspondence relationship of a region and a key color with a drive waveform mode. In this case, the display engine 22 specifies for each pixel 14 a region to which that pixel 14 belongs and a key color, and reads application voltages of a drive waveform mode corresponding to the specified region and key color from the waveform memory 29.

4-2. Variation 2

The details of processing performed by each of the pipes $P_1$ to $P_n$ are not limited to those described in the embodiment. It is also possible that when an instruction to rewrite an image is issued, the pipes $P_1$ to $P_n$ read all the portions that may possibly be used for processing from a drive waveform table that is stored in the waveform memory 29 and store the read table in the memories of the respective pipes $P_1$ to $P_n$. In this case, the pipes $P_1$ to $P_n$ each have an LUT (look-up table) memory for storing (a portion of) the drive waveform table. For example, in FIG. 13, the drive waveform mode 1 and the key color LG are assigned to the pipe $P_1$, and thus the pipe $P_1$ reads a portion of a drive waveform table of the drive waveform mode 1 in which the next gray level corresponds to LG from the waveform memory 29, and stores this portion in the LUT memory of the pipe $P_1$. When data on the current gray level and the next gray level is supplied from the data control unit 221, the pipe $P_1$ reads information on an application voltage corresponding to the supplied data and the counter value stored in the register from a table that is stored in the LUT memory. According to this example, it is necessary to read and store a drive waveform table from the waveform memory 29 before the start of the rewrite processing, but during rewriting, application voltages can be specified without accessing the waveform memory 29 for each pixel 14.

Also, reading of a drive waveform table from the waveform memory 29 to each pipe $P_1$ to $P_n$ may be performed in advance by executing a predetermined command from the CPU 31. In this case, setting of the parameters such as the key color can also be performed by a command from the CPU 31. Note that reading to the LUT memory is performed with respect to the entire drive waveform table that is selected, and execution of the relevant pipe can be selected based on the read key color.

4-3. Variation 3

In step S105, the pipes $P_1$ to $P_n$ may also be selected in accordance with the current gray level (data CI) instead of the next gray level (data NI). In an example, the host device 3 manages the current image (for example, stores the current image in the memory). If a region A of the current image contains three gray level values, the host device 3 outputs a total of three rewrite instructions corresponding to the respective gray level values. Alternatively, irrespective of the current image, the host device 3 may output rewrite instructions (i.e., four rewrite instructions) corresponding to the number of gray levels (four gray levels in the example of the embodiment) that can be produced by the electro-optical device 1.

4-4. Other Variations

In the display engine 22, it is also possible that a drive waveform mode that is common to all of the pipes $P_1$ to $P_n$ is used instead of using different drive waveform modes for different pipes $P_1$ to $P_n$. Depending on the drive waveform characteristics, the strangeness that has been described using FIG. 7 can be reduced by adjusting the offset without using different drive waveform modes.

In the display engine 22, the function related to the offset may be omitted. Depending on the drive waveform characteristics, the strangeness that has been described using FIG. 7 can be reduced by using different drive waveform modes without using the offset.

In the embodiment, a description of variations of the drive waveforms due to the environmental factors (e.g., temperature) is omitted, but the display controller 20 or the waveform memory 29 may vary the drive waveforms in accordance with the environmental factors. For example, the display controller 20 may change at least either of the time length of each frame and the application voltage values in accordance with an environmental factor. Alternatively, for example, if the waveform memory 29 stores drive waveform tables respectively corresponding to a plurality of temperature conditions, the waveform memory 29 outputs application voltage values that are read from a drive waveform table of a designated drive waveform mode, the drive waveform table corresponding to a given temperature.

The hardware configuration of the display controller 20 is not limited to that described using FIGS. 8 and 9. Also, the assignment of the functions to the various elements is not limited to that described in the embodiment. For example, the data that has been described as being stored in the registers of the data control unit 221 and the data that has been described as being stored in the VRAM 27 in the embodiment may be stored in a single storage. This storage may store, for example, the next gray level NI, the current gray level CI, the identification number of the pipe 222, and the drive waveform mode identification number for each pixel 14. The data control unit 221 outputs the next gray level NI, the current gray level CI, and the drive waveform mode identification number to a pipe that is indicated by data read from this storage. In another example, it is also possible that the display controller 20 does not have the VRAM 26 and the VRAM 27 and uses an external storage as the VRAM 26 and the VRAM 27. Moreover, it is also possible that the display controller 20 has the waveform memory 29.

The method of setting and updating counter values is not limited to that described in the embodiment. In the above embodiment, an example has been described in which a value obtained by adding the number of offset frames to the total number of frames of a drive waveform to be used is used as the initial counter value, and the counter value is decremented during counter update. In another example, it is also possible that zero is used as the initial counter value, and the counter value is incremented during counter update. In this case, in step S108, it is judged that rewriting is completed when the counter value reaches the maximum of the value that is obtained by adding the number of offset frames to the total number of frames of the drive waveform to be used.

The equivalent circuit of each pixel 14 is not limited to that described in the embodiment. Any combination of a switching element and a capacitor element is possible as long as a configuration that can apply a controlled voltage between the pixel electrode 114 and the common electrode 131 is achieved. Also, the method of driving this pixel 14 may be either of bipolar driving in which electrophoretic elements 143 to which voltages of different polarities are applied in a single frame are present and unipolar driving in which voltages of the same polarity are applied to all of the electrophoretic elements 143 in a single frame.

The structure of each pixel 14 is not limited to that described in the embodiment. For example, the polarities of charged particles are not limited to those described in the embodiment. It is also possible that the black electrophoretic particles are negatively charged, and the white electrophoretic particles are positively charged. In this case, the polarities of voltages that are applied to the respective pixels 14 are opposite to those described in the embodiment. Also, the gray levels are not limited to white and black (As already indicated, the gray levels need not be black and white. For example, one extreme optical state can be white and the other dark blue, so that the intermediate gray levels will be varying shades of blue, or one extreme optical state can be red and the other blue, so that the intermediate gray levels will be varying shades of purple.).

The bi-stable display element is not limited to an electrophoretic display element that uses microcapsules. It is also possible to use other display elements such as a Microcup electrophoretic display element, a twisting ball display element, an electronic liquid powder (registered trademark) display element, a cholesteric liquid crystal display element, a chiral nematic liquid crystal display element, an electrowetting display element, an electrochromic display element, and the like. Also, "bi-stable" is not limited to two states, but also includes multi-stable. (Widely speaking, bi-stable display technic is growing with more and more displaying gray scale/color depth, i.e. multi-stable display technic.)

The electronic apparatus 1000 is not limited to a tablet computer, and may be an apparatus other than tablet computers, such as an electronic book reader, an electronic organizer, a calculator, a POS terminal, a digital still camera, a cellular phone, a display device, and the like.

The invention has wide applications without departing from the gist thereof.

This application claims priority from Japanese Patent Applications No. 2013-166182 filed in the Japanese Patent Office on Aug. 9, 2013 and No. 2014-129970 filed in the Japanese Patent Office on Jun. 25, 2014, the entire disclosure of which is hereby incorporated by reference in its entirely.

What is claimed is:

1. An integrated circuit comprising:

an acquiring section that acquires image data corresponding to an image to be displayed by a bi-stable display element, the bi-stable display element having a pixel whose gray level changes in accordance with an application voltage; and an output section that outputs, from a first storage section that stores a plurality look up tables, each look up table comprising a plurality of voltage application patterns for a waveform mode for changing an optical state of the pixel to a designated gray level, a control signal for applying a voltage to a single target pixel of a plurality of pixels as defined above, the voltage being indicated by a pattern that is contained in a pattern group of the plurality of voltage application patterns that are selected in accordance with a position of the single pixel and a gray level value of the single pixel, the gray level value being indicated by the image data acquired by the acquiring section, wherein the output section comprises a plurality of sub-output sections, wherein a single gray level of a plurality of gray levels that can be produced by the bi-stable display element is assigned to each of the plurality of sub-output sections, wherein each of the plurality of sub-output sections outputs the control signal for a pixel with respect to which the image data indicates the corresponding single gray level, wherein a portion of a display region containing a plurality of pixels as defined above is assigned to each of the plurality of sub-output sections, wherein each of the plurality of sub-output sections outputs the control signal for the single pixel that is contained in the assigned portion of the display region, and wherein the output section combines waveform modes from the plurality of look up tables such that a first pixel having low relative lightness in a next image and a second pixel having a higher relative lightness than a relative lightness of the first pixel in the next image, the relative lightness of the second pixel is prevented from falling below the relative lightness of the adjacent first pixel in the course of transitions of the first and second pixels as the voltage is applied.

2. The integrated circuit according to claim 1, wherein a single pattern group of the plurality of pattern groups is assigned to each of the plurality of sub-output sections, and each of the plurality of sub-output sections outputs the control signal that applies a voltage indicated by a pattern that is contained in the assigned single pattern group to the single pixel.

3. The integrated circuit according to claim 1, further comprising:

a second storage section that stores first image data indicating gray levels of respective pixels of an image after rewriting and a third storage section that stores second image data indicating gray levels of respective pixels of an image before rewriting, wherein the acquiring section acquires the first image data and the second image data as the image data.

4. The integrated circuit according to claim 1, wherein the pattern indicates a change in application voltage in every unit time period, each of the plurality of sub-output sections has a counter for specifying a single time period in the pattern, and each of the plurality of sub-output sections outputs the control signal that applies a voltage corresponding to the single time period of the pattern to the single pixel, the single time period being specified by the counter.

5. The integrated circuit according to claim 4, wherein each of the plurality of sub-output sections uses a value that depends on a designated number of unit time periods and a number of unit time periods in the selected pattern group as an initial value of the counter.

6. A method of controlling a bi-stable display element having a plurality of pixels, the method comprising:

receiving image data corresponding to an image to be displayed by the bi-stable display element, the bi-stable display element having a pixel whose gray level changes in accordance with an application voltage;

receiving from a first sub-output section of an output section, based on at least the image data, a first waveform from a first storage section for changing a plurality of first pixels from a first gray level to a second gray level;

receiving from a second sub-output section of an output section, based on at least the image data, a second waveform for changing a plurality of second pixels from a third gray level to a fourth gray level from the first storage section, the third gray level being different from the first gray level or the fourth gray level being different from the second gray level;

causing the start of voltage application to the second pixels based on the second waveform to be delayed from the start of voltage application to the first pixels based on the first waveform with a delay of "n" frames ("n" is an integer of 1 or more); and wherein the first storage section stores a plurality of look up tables, a plurality of voltage application patterns for a waveform mode for changing an optical state of a selected pixel to a changed grey level, the changed gray level being indicated by a pattern that is contained in the pattern group of the plurality of voltage application patterns groups that are that is selected in accordance with a position of the selected pixel and an initial gray level of the selected pixel, the changed level value being indicated by the received image data, and wherein the waveform modes from the plurality of look up tables are combined such that a first pixel having low relative lightness in a next image and a second pixel having a higher relative lightness than a relative lightness of the first pixel in the next image, the relative lightness of the second pixel is prevented from falling below the relative lightness of the adjacent first pixel in the course of transitions of the first and second pixels as the voltage is applied.

7. The method of controlling a bi-stable display element according to claim 6, wherein when the second gray level and the fourth gray level are in a first extreme optical state, and the third gray level is in a second extreme optical state that is opposite to the first extreme optical state, the start of voltage application to the first pixel based on the first waveform is delayed such that the first pixel changes from the first gray level to the third gray level and then changes to the second gray level, and the second pixel changes from the third gray level to the fourth gray level together with the first pixel.

8. The method of controlling a bi-stable display element according to claim 6, wherein the first waveform corresponds to "m" frames ("m" is an integer of 2 or more), and "n" is smaller than "m".

9. The method of controlling a bi-stable display element according to claim 6, wherein the first pixel is adjacent to the second pixel, the third gray level and the fourth gray level are put in the first extreme optical state or the second extreme optical state that is opposite to the first extreme optical state by anti-aliasing, and at least one of the first gray level and the second gray level is set at an intermediate gray level by the anti-aliasing.

10. The method of controlling a bi-stable display element according to claim 6, wherein the start of the second waveform is delayed in order to reduce a difference between a gray level of a pixel rewritten by the first waveform and a gray level of a pixel rewritten by the second waveform during rewriting.

11. The method of controlling a bi-stable display element according to claim 6, wherein the first waveform corresponds to "m" frames ("m" is an integer of 2 or more), the second waveform corresponds to "n" frames ("n" is an integer of 1 or more), and "n" is smaller than "m".

12. The method of controlling a bi-stable display element according to claim 11, wherein the first waveform is used in a reduced afterimage mode, and the second waveform is used in high rewrite speed mode.

* * * * *